US008066153B2

(12) United States Patent
Decottignies et al.

(10) Patent No.: US 8,066,153 B2
(45) Date of Patent: Nov. 29, 2011

(54) DEVICE FOR DISPENSING A FLUID PRODUCT

(75) Inventors: Laurent Decottignies, Cergy (FR); Alain Behar, Suresnes (FR)

(73) Assignee: Airlessystems, Charleval (FR)

( * ) Notice: Subject to any disclaimer, the term of this patent is extended or adjusted under 35 U.S.C. 154(b) by 620 days.

(21) Appl. No.: 12/160,146

(22) PCT Filed: Mar. 20, 2007

(86) PCT No.: PCT/FR2007/050957

§ 371 (c)(1), (2), (4) Date: Nov. 7, 2008

(87) PCT Pub. No.: WO2007/110528

PCT Pub. Date: Oct. 4, 2007

(65) Prior Publication Data

US 2009/0090746 A1 Apr. 9, 2009

(30) Foreign Application Priority Data

Mar. 29, 2006 (FR) ..... 06 51077

(51) Int. Cl.
*B65D 37/00* (2006.01)

(52) U.S. Cl. ..... 222/209; 222/260

(58) Field of Classification Search ..... 222/209, 222/207, 260, 238, 256, 257, 340, 372, 378, 222/380

See application file for complete search history.

(56) References Cited

U.S. PATENT DOCUMENTS

| | | | | |
|---|---|---|---|---|
| 4,154,371 | A * | 5/1979 | Kolaczinski et al. | 222/212 |
| 4,413,759 | A * | 11/1983 | Mettenbrink | 222/213 |
| 4,598,843 | A * | 7/1986 | Foster et al. | 222/153.13 |
| 4,775,080 | A | 10/1988 | Mettenbrink | |
| 4,991,744 | A * | 2/1991 | Von Schuckmann | 222/136 |
| 5,042,694 | A * | 8/1991 | Birmelin | 222/145.3 |
| 5,052,592 | A | 10/1991 | Wilken et al. | |
| 5,377,880 | A * | 1/1995 | Moretti | 222/207 |
| 6,991,135 | B2 * | 1/2006 | von Schuckmann | 222/209 |
| 7,195,136 | B2 * | 3/2007 | von Schuckmann | 222/209 |
| 7,694,856 | B2 * | 4/2010 | Rossignol | 222/386 |

FOREIGN PATENT DOCUMENTS

DE 34 35 576 A1 4/1986

* cited by examiner

*Primary Examiner* — Lien Ngo
(74) *Attorney, Agent, or Firm* — Sughrue Mion, PLLC

(57) ABSTRACT

A fluid dispenser device comprising: a reservoir (R) of variable working volume comprising a sealing slide-cylinder (100) and a follower piston (2) that is in sliding sealing contact in said cylinder; dispenser means (3) that are suitable for putting the fluid stored in the reservoir under pressure in such a manner as to drive a fraction of the fluid through a dispenser orifice (37), and under suction in such a manner as to move the follower piston in the direction that decreases the working volume of the reservoir; and non-return means that are suitable for preventing any substantial movement of the follower piston in the direction that increases the working volume of the reservoir; in which device the non-return means include at least one chamber (C) of variable volume that is filled with fluid from the reservoir during the suction stage.

15 Claims, 4 Drawing Sheets

DEVICE FOR DISPENSING A FLUID PRODUCT

Figure 1:
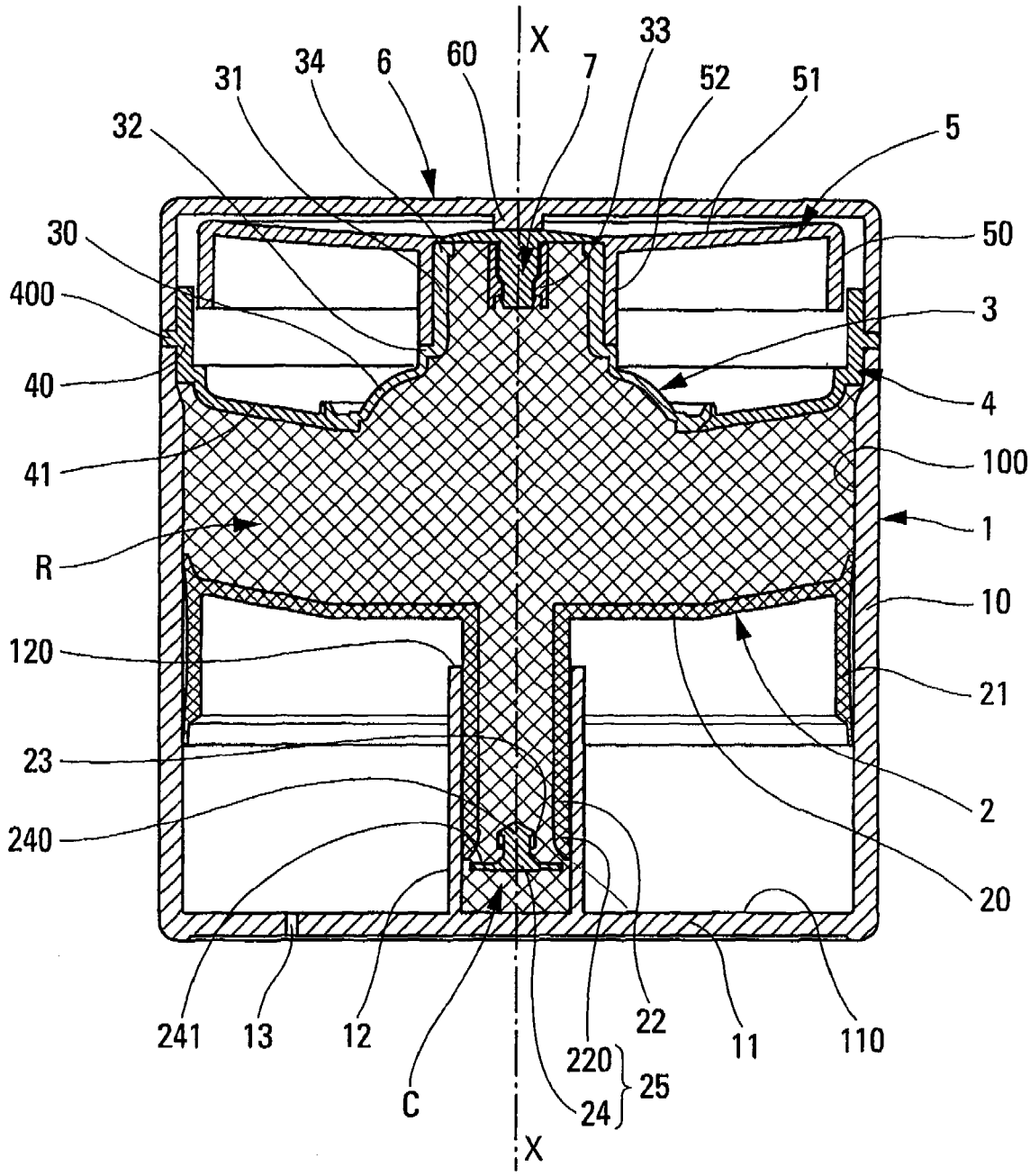

The present invention relates to a fluid dispenser device. In particular, the present invention relates to a dispenser device that is specially adapted to dispensing fluid that presents a viscous consistency.

Advantageous, but not exclusive, fields of application of the present invention include the fields of cosmetics, perfumery, and pharmacy.

The prior art includes numerous devices that make it possible to dispense a fluid contained in a reservoir. Generally, such devices implement dispenser means, such as a pump system, that are secured to the reservoir. In order to operate such dispenser means, an actuator member is usually provided, which the user can press with a finger.

However, such devices present a certain number of drawbacks. In particular, such devices do not necessarily make it possible to avoid the fluid coming into contact with the outside atmospheric air, which could result in microbiological contamination of said fluid and/or in physico-chemical changes in the fluid. By way of example, such a change could be oxidization or drying of the fluid that thus becomes more difficult to dispense and to apply to a given surface, such as a cutaneous surface.

That problem is frequently encountered when using air-intake dispenser means in which the dispensing of a volume of fluid creates suction within the reservoir, which suction is compensated by atmospheric air being taken into the reservoir, thereby coming directly into contact with the fluid.

In order to mitigate that problem, so-called "airless" dispenser means have been proposed. Such systems generally implement a reservoir having a working volume, i.e. a volume that is dedicated exclusively to containing the fluid to be dispensed, that varies each time fluid is dispensed.

By way of example, such a system can include a reservoir inside which a follower piston slides in sealing contact. In this event, the follower piston can be likened to a wall that defines the bottom of the reservoir, and that moves in the direction that decreases the working volume of the reservoir each time the dispenser means are actuated. When a user operates the dispenser means, that causes the incompressible fluid contained in the reservoir to be put under pressure. Putting the fluid under pressure in this way can initially thus cause the follower piston to move in the direction that increases the working volume of the reservoir, and can consequently cause the fluid contained in the reservoir to be expelled unintentionally through the dispenser orifice.

In order to overcome that problem, one prior-art solution consists in using non-return means for the follower piston. Such non-return means seek to prevent any movement of the follower piston in the direction that increases the working volume of the reservoir. Until the present, such non-return means have been constituted by a rigid part made out of a hard plastics material or preferably out of metal, and they have been associated with the follower piston. Over its circumference, the rigid part, having the general shape of an upside-down dish, includes notches that are generally spaced-apart uniformly around the circumference. The notches thus define between them a plurality of tabs that have a certain degree of flexibility. This flexibility enables them to expand radially while the dispenser means are being operated, and thus enables them to bite into the inside wall of the reservoir so as to prevent the piston from reversing while the fluid is being put under pressure as a result of the dispenser means being actuated. Once the fluid has been expelled and the dispenser means have been released, a suction stage is established in the reservoir, and the non-return means, that are constrained to move with the follower piston, deform and move in the cylinder in the direction that decreases the working volume of the reservoir.

However, the use of such non-return means presents various drawbacks. Firstly, the rigid part needs to have flexibility suitable for biting into the inside wall of the reservoir only when the dispenser means are operated. Secondly, the rigid part needs to present a configuration and a size that are precise so as to match the inside of the reservoir, and so as not to hinder the movement of the follower piston. Furthermore, securing such a rigid part to the follower piston requires an additional step in the manufacture and assembly of the dispenser device. Finally, adding such a part to the device necessarily creates additional expense, and thus a greater production cost.

An object of the present invention is to remedy the above-mentioned drawbacks of the prior art.

An object of the present invention is to provide a dispenser device that guarantees uniform and substantially reproducible fluid dispensing each time the dispenser means are actuated. To do this, an object of the present invention is to provide a fluid dispenser device that avoids any reverse movement of the follower piston in the direction that increases the working volume of the reservoir while the dispenser means are being actuated.

Another object of the present invention is to provide a fluid dispenser device that is simple and inexpensive to manufacture.

The present invention thus provides a device comprising: a fluid reservoir of variable working volume comprising a sealing slide-cylinder and a follower piston that is in sliding sealing contact in said cylinder; dispenser means that are suitable for putting the fluid stored in the reservoir under pressure in such a manner as to drive a fraction of the fluid through a dispenser orifice, and under suction in such a manner as to move the follower piston in the direction that decreases the working volume of the reservoir; and non-return means that are suitable for preventing any substantial movement of the follower piston in the direction that increases the working volume of the reservoir; in which device the non-return means include at least one chamber of variable volume that is filled with fluid from the reservoir during the suction stage. In other words, the volume of said chamber increases with the movement of the follower piston in the direction that decreases the working volume of the reservoir.

Advantageously, said chamber includes a movable wall that is movable during the suction stage.

Advantageously, said reservoir communicates with said chamber through a passage that is provided with a unidirectional device that is suitable for selectively enabling the chamber to be filled, and for preventing the chamber from being emptied.

Advantageously, said unidirectional device is a check valve.

In a variant, said unidirectional device may be formed by at least one through passage that presents a section that is small compared to the section of the dispenser orifice.

Advantageously, said passage is formed in the movable wall.

Advantageously, said movable wall is secured to the follower piston.

Advantageously, the device includes a stationary chimney, said follower piston including a sleeve that is mounted in sliding sealing contact in said chimney, the movable wall being secured to the sleeve and co-operating with the chimney to define the non-return chamber.

Advantageously, said chimney and said slide cylinder both present a cylindrical configuration, said chimney occupying a position that is substantially central relative to said cylinder, such that said chimney and said cylinder are coaxial, and are preferably made as a single part.

Advantageously, said reservoir occupies an intermediate axial position between the dispenser orifice and the chamber of variable volume, the direction in which the fluid flows through said passage into said chamber of variable volume being opposite to the direction in which the fluid is expelled through the dispenser orifice.

Advantageously, said dispenser means comprise an elastically-deformable membrane, and a pusher on which the user can press manually so as to deform said membrane.

Advantageously, said dispenser orifice is closed selectively by an outlet valve.

Advantageously, the follower piston moves in the cylinder in an axial direction X, with the volume of the chamber C increasing in the axial direction X. In another aspect, in the pressure stage, the follower piston bears against the chamber C that is full of fluid.

One of the principles of the chamber resides in the fact that it acts like a unidirectional hydraulic actuator that can only extend, and never retract. Thus, the chamber creates a column of fluid that is incompressible by definition, and on which the follower piston bears when the fluid stored in the reservoir is put under pressure. An advantage of the present invention is to use a very small fraction of the fluid stored in the reservoir to create the column of fluid. The non-return function is thus guaranteed without it being necessary to add any additional part, as in the prior art.

Figures 2A, 2B, 2C:
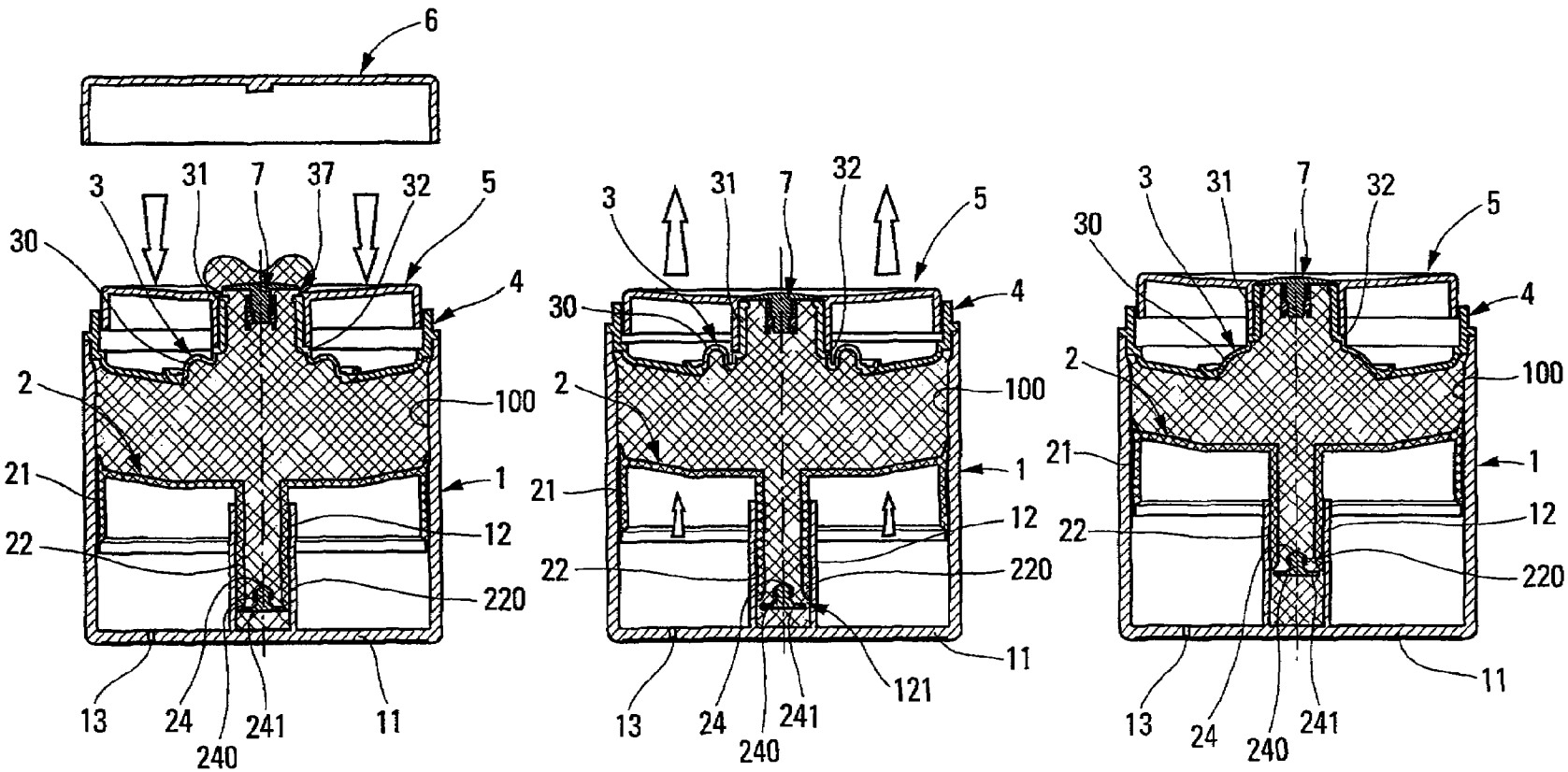
Figure 3:
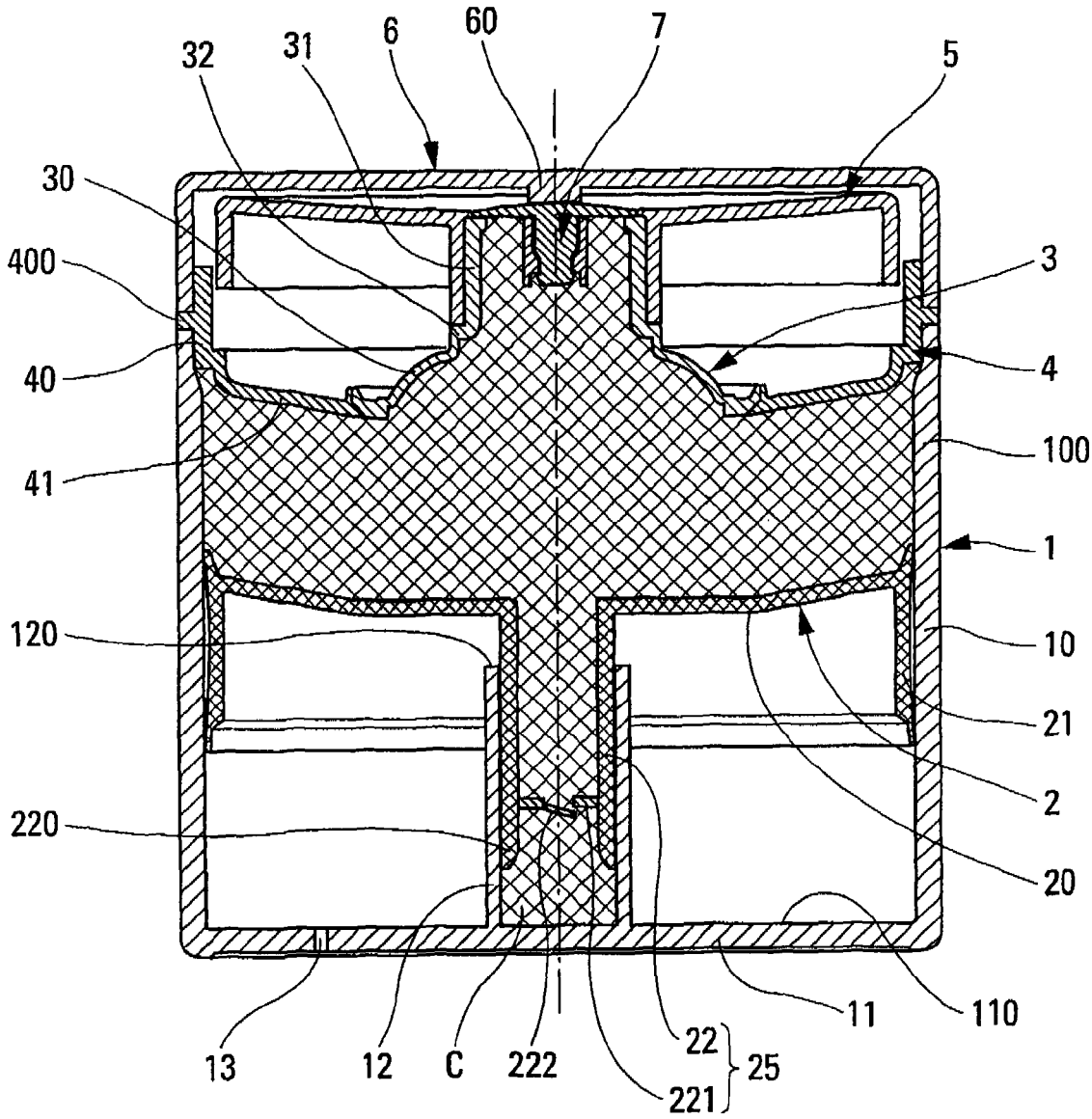
Figure 4:
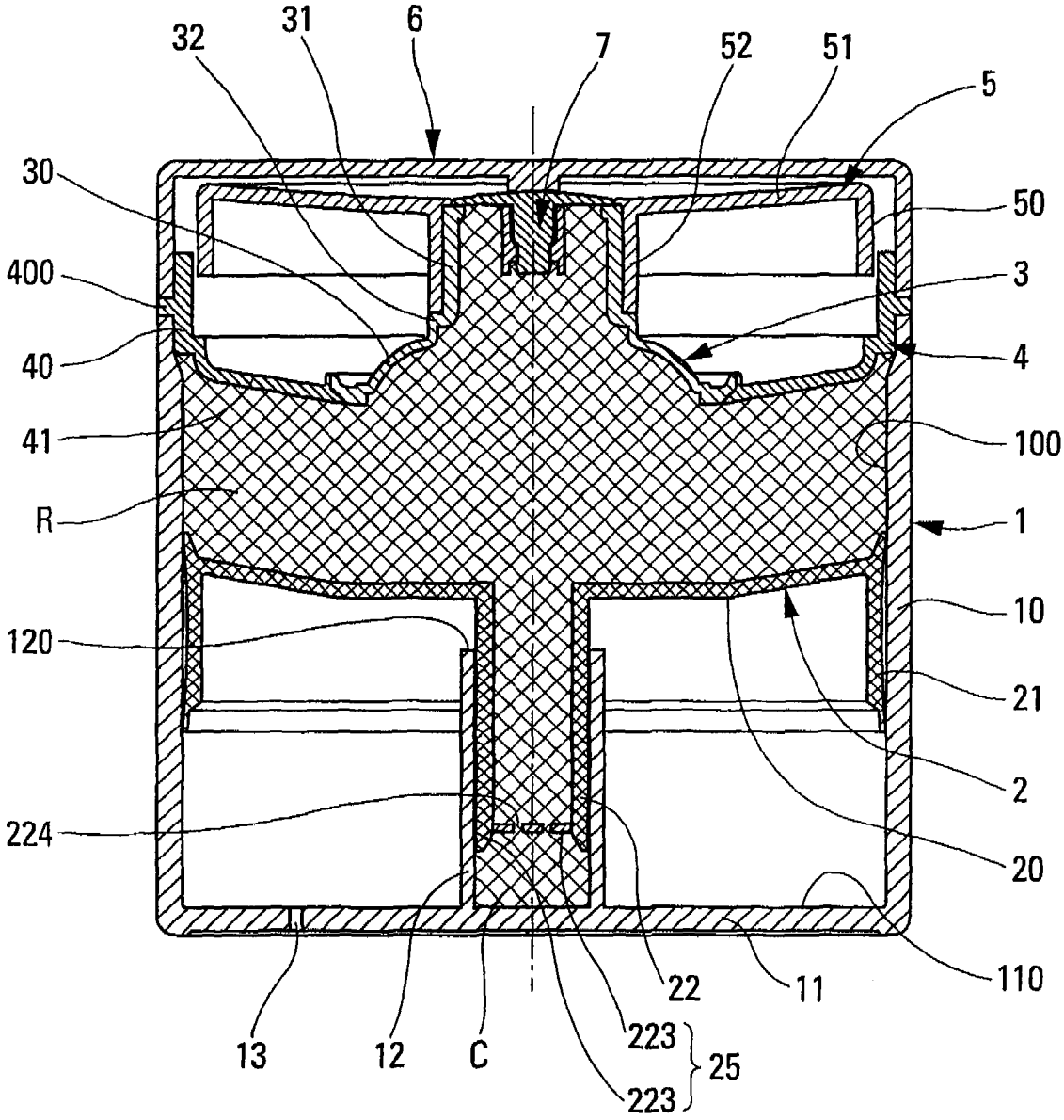

Other characteristics and advantages of the present invention appear more clearly from the following detailed description, given merely by way of non-limiting example, and with reference to the accompanying drawings, in which:

FIG. 1 is a diagrammatic section view of a fluid dispenser device constituting a first embodiment of the present invention;

FIGS. 2*a*, 2*b*, and 2*c* show the operation of the FIG. 1 device;

FIG. 3 is a diagrammatic section view of a fluid dispenser device constituting a second embodiment of the present invention; and FIG. 4 is a diagrammatic section view of a fluid dispenser device constituting a third embodiment of the present invention.

FIG. 1 shows a particular embodiment of a fluid dispenser device of the present invention. In general, the device of the present invention comprises: a body 1; a follower piston 2 that is mounted inside the body; dispenser means 3 that are secured to the body by means of a fastener piece 4; and an actuator member 5 that is suitable for being pressed manually so as to actuate said dispenser means. The various component parts of the device are described below in greater detail.

The body 1 comprises a side wall 10 including a top end that is open, and bottom end that is closed by a bottom wall 11. The side and bottom walls each present a respective inside surface 100, 110 and said surfaces co-operate with each other to define the overall potential volume of said body. The body can advantageously present the general shape of a pot or of a cup, and, in particular, the inside surface 100 advantageously presents a configuration that is completely cylindrical. As described below, such a cylindrical configuration of the inside surface is particularly useful in the present invention, since the surface actually forms a slide cylinder for the follower piston 2.

The bottom wall includes a vent hole 13 and a chimney 12. The vent hole 13 is a through hole that is formed through the bottom wall, putting the inside of the body into communication with the outside atmospheric air. The chimney projects upwards from said bottom wall in such a manner that the chimney presents a bottom end that is closed by said bottom wall, and a top end that is open and that is defined by a top edge 120. Such a chimney can thus be likened to a blind bushing. As in the embodiments shown, the chimney can be made integrally with said body (and in particular with said bottom wall), or it can be a separate part that is suitable for being held in stationary manner in said body (and in particular on said bottom wall), e.g. by snap-fastening, by adhesive, by heat sealing, by screw-fastening, etc. Advantageously, said chimney 12 presents a configuration that is cylindrical and that occupies a position that is substantially central relative to said inside surface 100 of the side wall of the body, such that the chimney and the inside surface are coaxial.

The follower piston 2 includes a disk 20 that is substantially radial and that is provided externally with slide lips 21 and at its center with a sleeve 22. More precisely, the slide lips 21 extend circumferentially around the radial disk 20. The sleeve 22 projects downwards from the radial disk 20. The sleeve 22 internally forms a duct that, as shown in FIG. 1, presents a free bottom end 220 that fulfils two functions. The end externally defines a sealing lip for sliding in sealing manner in the chimney 12. The free end internally defines a valve seat that is suitable for co-operating with a check valve 24. The valve comprises a foot 240 that is slidably mounted in a ring 23 that is secured to the sleeve 22, and a disk 241 that is suitable for selectively coming to bear in sealing manner against the seat formed by the free end 220. The function of the valve is explained in greater detail in the description below. The free end 220 and the disk 241 co-operate with each other to define a wall 25 that is secured to the sleeve 22, but that is movable relative to the chimney 12, since the sleeve can slide in the chimney.

The follower piston 2 is inserted inside the body 1 through its open top end. The slide lips 21 thus establish sliding sealing contact in the cylinder 100 of the side wall 10 of the body. The sleeve 22 is received inside the chimney 12 and establishes sliding sealing contact with said chimney. The sealing contact results from the sealing lip of the sleeve 22 co-operating with said chimney 12. In a variant, the chimney can form a sliding sealing lip around the sleeve. For example, such a sealing lip can extend radially outwards from the free end 220 of the sleeve and/or can extend radially inwards from the top edge 120 of the chimney.

As shown in FIG. 1, the inside surface 110 of the bottom wall of the body, the chimney 12, and the wall 25 co-operate with one another to define a fluid chamber C of variable volume. Initially, the chamber C can be completely empty. However, the chamber C can increase in volume by moving the wall 25 which is thus a movable wall of the chamber. The wall is moved by moving the follower piston in the direction that decreases the working volume of the reservoir, as described below.

The dispenser means 3 comprise a fluid dispenser channel 31 and an elastically-deformable membrane 30 that are interconnected via an outer step 32. The membrane 30 flares outwards from the step 32. The membrane thus presents the general shape of a dome. Furthermore, the dispenser means can include a ring 33, e.g. secured to the dispenser channel 31, forming a support member for an outlet valve 7. The outlet valve 7 can be of configuration that is similar to the check valve 24 (as shown in FIG. 1), or it can be of configuration that is different therefrom. The valve 7 rests in sealing manner against a valve seat 34 that is formed by the top edge of the channel 31. In the absence of pressure or in the suction stage, the valve rests against its seat, whereas in the increased pressure or dispensing stage, the valve lifts off its seat, thereby forming a dispenser orifice 37 that is annular in this embodiment. The dispenser means, which in this embodiment can be likened to a pump system, could be implemented in some other way in the present invention. Any dispenser means that are suitable for putting the fluid contained in the reservoir under pressure can be used.

The dispenser means 3 are associated with the body by means of a fastener member 4. The fastener member comprises a fastener ring 40 and a dish 41. In order to assemble the dispenser means on the body, the elastically-deformable membrane 30 is connected in stationary manner to the dish 41, while the fastener ring 40 is engaged in stationary manner with the open top end of the body 1. In order to limit said engagement, the fastener ring can include a radial collar 400 that is suitable for coming into abutment on the top end of the body. Naturally, the fastener member is only an example that is thus entirely non-limiting for implementing the present invention. For example, the fastener member could be a member that is screw-fastened, snap-fastened, or crimped onto the top end of the body.

Thus, a fluid reservoir R is defined by the follower piston 2, the cylinder 100, the dish 41, and the membrane 30. The reservoir is preferably completely full of fluid, as can be seen in FIG. 1. The reservoir R is of capacity that can be varied by deforming the membrane 30 and by moving the follower piston 2. It communicates with the dispenser orifice 37 through the channel 31 and the sleeve 22 of the follower piston.

The actuator member or pusher 5 comprises a finger-press bearing surface 51 from which a peripheral skirt 50 and a force transmission member 52 extend downwards. The actuator member 5 is secured to the dispenser means 3 by positioning the force transmission member 52 in clamping engagement around the dispenser channel 31. In the final assembly position, the force transmission member 52 comes to bear against the outer step 32 of the dispenser means. The peripheral skirt is positioned inside the fastener ring 40. Pressure exerted on the surface 51 of the pusher thus causes the pusher to move axially along the axis X, thereby causing the membrane 30 to deform. The fastener ring 40 can thus act as a guide for the peripheral skirt over the entire actuation stroke of the pusher. Naturally, such an embodiment of an actuator member is non-limiting for implementing the present invention.

In addition, a cap 6 can be mounted on the fluid dispenser device. In its mounted position, the cap can be placed in clamping engagement around the fastener ring 40. Axial travel of the cap 6 can be limited by the radial projection 400 of the fastener member. In addition, the cap 6 can include a projection 60 that is suitable for coming to bear against the outlet valve 7 in such a manner as to press said valve against the top end of the dispenser channel 31, and thereby prevent any accidental dispensing of the fluid contained inside the working volume of the reservoir.

The operating principle of the fluid dispenser device of the invention is described in greater detail below, with reference to FIGS. 1, 2*a*, 2*b*, and 2*c*.

In FIG. 2*a*, the cap 6 has been removed and the fluid dispenser device is actuated by pressing a finger on the surface 51. The force transmission member 52 thus acts on the membrane 30 that is thus deformed, thereby putting the incompressible fluid contained inside the working volume of the reservoir under pressure. Putting the fluid under pressure in this way thus causes fluid to be dispensed through the dispenser orifice 37 that is formed between the outlet valve 7 and the dispenser channel 31. While it is put under such pressure, the check valve 24 of the sleeve 22 closes, thereby preventing any communication between the reservoir R and the chamber C. The valve 24 is closed by the increase in pressure in the chamber C that is much faster and much greater than in the reservoir R. This results from the large difference between the diameter of the reservoir and the diameter of the chamber. The disk 241 of the valve 24 is thus pressed against its seat that is formed by the free end 220 of the sleeve. Therefore, no fluid can pass between the reservoir and the chamber. The fluid contained in the chamber C thus forms a buffer or column of incompressible fluid and the follower piston bears against said column, thereby preventing it from moving in the direction that increases the working volume of the reservoir while the dispenser means are being actuated. Thus, any movement of the follower piston away from the dispenser orifice 72 is prevented. The wall 25 formed at the bottom end of the sleeve remains stationary during this increased pressure stage.

In FIG. 2*b*, pressure on the dispenser means 3 has been stopped. At this moment, the elastically-deformable membrane 30, provided with shape memory, returns to its original shape. This return to its original shape thus creates suction inside the working volume of the reservoir. The suction causes the follower piston to move upwards in the direction that decreases the working volume of the reservoir. During the suction stage, the slide lips 21 and the sleeve 22 move in sliding sealing contact in the cylinder 10 and in the chimney 12 respectively. The movement of the sleeve in the chimney causes the movable wall 25 that incorporates the check valve 24 to move. The movement of the wall 25 is accompanied by the valve 24 opening, since the suction in the chamber C increases faster than in the reservoir R. Once again, this is as a result of the large difference between the diameter of the reservoir and the diameter of the chamber. Thus, the movement of the wall 25 and the simultaneous opening of the valve 24 cause the fluid from the reservoir R to penetrate into the chamber C. This causes the working volume of the chamber C to increase, increasing the axial height of the column of fluid against which the follower piston will bear during the next increased pressure stage.

In FIG. 2*c*, the elastically-deformable membrane 30 has returned to its original configuration. The fluid dispenser device has thus returned to its rest position, and the dispenser means 3 can once again be actuated. As shown in this figure, the chamber C contains a volume of fluid that is greater than the volume of fluid that was present before said dispenser means were actuated.

If the dispenser device is actuated once again, the same operating sequence will occur. Thus, each actuation of the dispenser means causes the volume of the chamber C to increase successively. In other words, the volume of said chamber increases sequentially each time the follower piston moves in the direction that decreases the working volume of the reservoir. Thus, at each increased pressure stage, the follower piston can bear against an increasingly tall column of incompressible fluid that has been supplied by the reservoir R during the suction stage. The chamber C thus repeatedly provides an non-return function for the follower piston during the increased pressure stages. The fluid necessary for filling the chamber C is minimal, compared to the volume of the reservoir R. The ratio is 1/40. The loss of fluid is therefore about 2.5%, which is very small.

The check valve 24 constitutes an advantageous embodiment for a unidirectional device that is suitable for selectively and momentarily forming a passage for filling the chamber C from the reservoir R. As described above, such a device guarantees that the chamber is filled only during the reservoir suction stage, and prevents the chamber from being emptied during the stage when the fluid contained in the reservoir is put under pressure. Other forms of check valve, such as ball valves or flexible membrane valves could also be used.

FIGS. 3 and 4 show other embodiments of unidirectional devices that are suitable for being implemented in a fluid dispenser device of the present invention.

In FIG. 3, the unidirectional device is a valve including a transverse wall 221 that is constrained to move with the sleeve 22. The wall has an orifice passing therethrough that is suitable for being closed selectively by means of a rigid or flexible tab 222. Actuating the dispenser means 3 puts the fluid contained in the reservoir under pressure. The tab 222 thus presses against the wall 221 and prevents any fluid from passing from the reservoir to the chamber C. Conversely, during the suction stage, the follower piston moves in the direction that decreases the working volume of the reservoir, and the tab 222 lifts off the wall 221. The movement of the tab forms a passage between the working volume of the reservoir and the chamber 120, thereby making it possible to fill the chamber 120.

In FIG. 4, the unidirectional device comprises a transverse wall 223 that is constrained to move with the sleeve 22. The wall includes one or more through holes 224, each presenting a section that is small compared to the section of the dispenser orifice. In manner similar to the other embodiments, actuating the dispenser means puts the fluid contained in the reservoir under pressure. However, the size of the through holes 224 does not enable the fluid contained in the working volume of the reservoir to reach the chamber C, since the fluid pressure existing in the chamber C is much greater than the fluid pressure existing in the working volume of the reservoir. Conversely, during the suction stage, the fluid contained in the working volume of the reservoir can pass through the through holes 224. The chamber C is thus filled with fluid from the reservoir.

In all of the embodiments, the follower piston bears against a chamber that includes a movable wall 25 that is secured to the follower piston. The movement of the follower piston causes the volume of the chamber to increase, with fluid from the reservoir passing through a unidirectional device. The chamber is disposed axially, opposite the dispenser orifice, but other configurations could be envisaged.

Although the present invention is described above with reference to particular embodiments thereof, it is clear that it is not limited by said embodiments. On the contrary, any useful modification could be applied thereto by a person skilled in the art, without going beyond the ambit of the present invention, as defined by the accompanying claims.

The invention claimed is:

1. A fluid dispenser device comprising:

a reservoir (R) of variable working volume comprising a sealing slide-cylinder (100) and a follower piston (2) that is in sliding sealing contact in said cylinder;

dispenser means (3) that are suitable for putting the fluid stored in the reservoir under pressure in such a manner as to drive a fraction of the fluid through a dispenser orifice (37), and under suction in such a manner as to move the follower piston in the direction that decreases the working volume of the reservoir; and non-return means that are suitable for preventing any substantial movement of the follower piston in the direction that increases the working volume of the reservoir;

the device being characterized in that the non-return means include at least one chamber (C) of variable volume that is filled with fluid from the reservoir during the suction stage.

2. A fluid dispenser device according to claim 1, in which the volume of said chamber (C) increases with the movement of the follower piston (2) in the direction that decreases the working volume of the reservoir.

3. A fluid dispenser device according to claim 2, in which said chamber (C) includes a movable wall (25) that is movable during the suction stage.

4. A fluid dispenser device according to claim 1, in which said reservoir communicates with said chamber through a passage (121; 224) that is provided with a unidirectional device (220, 24; 221, 222; 223; 224) that is suitable for selectively enabling the chamber to be filled, and for preventing the chamber from being emptied.

5. A fluid dispenser device according to claim 3, in which said unidirectional device (220, 24; 221, 222) is a check valve.

6. A fluid dispenser device according to claim 3, in which said unidirectional device is formed by at least one through passage (224) that presents a section that is small compared to the section of the dispenser orifice.

7. A fluid dispenser device according to claim 3, in which said passage is formed by the movable wall (25).

8. A fluid dispenser device according to claim 3, in which said movable wall (25) is secured to the follower piston (2).

9. A fluid dispenser device according to claim 8, including a stationary chimney (12), said follower piston (2) including a sleeve (22) that is mounted in sliding sealing contact in said chimney (12), the movable wall being secured to the sleeve and co-operating with the chimney to define the chamber (C).

10. A fluid dispenser device according to claim 9, in which said chimney (12) and said slide cylinder (100) are secured to each other, and both present a cylindrical configuration, said chimney (12) occupying a position that is substantially central relative to said cylinder (100), such that said chimney (12) and said cylinder are coaxial, and are preferably made as a single part.

11. A fluid dispenser device according to claim 4, in which the reservoir (R) occupies an intermediate axial position between the dispenser orifice (37) and the chamber (C), the direction in which the fluid flows through said passage into said chamber (C) being opposite to the direction in which the fluid is expelled through the dispenser orifice (37).

12. A fluid dispenser device according to claim 1, in which the follower piston (2) moves in the cylinder (100) in an axial direction X, with the volume of the chamber (C) increasing in the axial direction X.

13. A fluid dispenser device according to claim 1, in which, in the pressure stage, the follower piston (2) bears against the chamber (C) that is full of fluid.

14. A fluid dispenser device according to claim 1, in which said dispenser means (3) comprise an elastically-deformable membrane (30), and an actuator member (5) on which the user can press manually so as to deform said membrane (30).

15. A fluid dispenser device according to claim 1, in which said dispenser orifice (37) is closed selectively by an outlet valve (7).

* * * * *